United States Patent [19]

Young

[11] Patent Number: 5,038,505

[45] Date of Patent: Aug. 13, 1991

[54] MULTI-PURPOSE DESK-TOP PICTURE FRAME

[76] Inventor: Jean Young, F2, No. 52, Tiann Shoei Rd., Taipei, Taiwan

[21] Appl. No.: 521,634

[22] Filed: May 10, 1990

[51] Int. Cl.[5] ..... B65D 71/72; A45C 11/34

[52] U.S. Cl. ..... 40/358; 206/214; 206/224

[58] Field of Search ..... 40/159, 358, 152.1, 40/119; 281/31, 33; 206/81, 224, 214, 0.08; 402/73

[56] References Cited

U.S. PATENT DOCUMENTS

| | | | |
|---|---|---|---|
| 405,160 | 6/1889 | Hamilton, Jr. | 40/119 |
| 609,230 | 8/1898 | Haegelin | 281/31 |
| 665,057 | 1/1901 | Brower | 206/214 |
| 1,041,923 | 10/1912 | Weeks | 40/152.1 |
| 1,399,880 | 12/1921 | Reed | 40/119 |
| 3,764,167 | 10/1973 | Longarzo | 40/152.1 |
| 4,327,961 | 5/1982 | Kladitis | 350/66 |
| 4,365,434 | 12/1982 | Doyel | 40/119 |

FOREIGN PATENT DOCUMENTS

| | | | |
|---|---|---|---|
| 26976 | 10/1911 | United Kingdom | 281/33 |

*Primary Examiner*—Kenneth J. Dorner
*Assistant Examiner*—Cassandra L. Hope
*Attorney, Agent, or Firm*—Varndell Legal Group

[57] ABSTRACT

A desk-top picture frame has a base frame with a hollow structure, a front opening through which things can be placed in and removed from the inner chamber thereof, a mirror on the front panel thereof, a loose-leaf clip on the top edge thereof for holding picture frame sheets, note book, memo pad or wall calendar. The side wall of the base frame is formed of a plurality of transverse ribs curvilinearly bent inward and outward to define an area serving as a pen case.

12 Claims, 3 Drawing Sheets

MULTI-PURPOSE DESK-TOP PICTURE FRAME

BACKGROUND OF THE INVENTION

The present invention is related to picture frames and, more particularly, to a desk-top picture frame which can be simultaneously used for several purposes.

A desk-top picture frame is an ornamental border surrounding a picture for showing a picture on the top of a desk. When it is desired to show several pictures at a time, several such desk-top picture frames are necessary and inevitably, a large amount of big space occupation on a desk is also necessary. There is another method for collecting pictures in a loose-leaf book which has blank pages for mounting pictures. The disadvantage of this method is that pictures can not be vertically mounted on a desk or any flat surface for show.

In addition to a desk-top picture frame, a desk calendar, memo pad, telephone note book, cash box, standing mirror, pen case, stationery case and etc., are also commonly seen on one's desk. When these items are all placed on one's desk, the whole top surface of the desk becomes fully occupied with little space left for writing or reading. Although a type of multi-purpose desk calendar has been commercialized, which combines with a pen case together for holding a variety of writing materials, it still can not fully satisfy consumer's requirement. Therefore, it is an idea of the present inventor to provide a picture frame which has a loose-leaf clip for holding wall calendar, loose-leaf telephone note-book, loose-leaf memo pad, and loose-leaf pages which can be used for mounting pictures so that pictures can be shown on the top of a desk, and which includes receiving chambers for collecting a variety of miscellaneous items.

SUMMARY OF THE INVENTION

The present invention has been accomplished under the circumstances in view of the above. It is an object of the present invention is to provide a multi-purpose desk-top picture frame which can be simultaneously used as a picture frame, a storage chamber, a standing mirror, a desk calendar, and a stationary case.

Another object of the present invention is to provide a multi-purpose desk-top picture frame which can minimize space occupation.

According to the present invention, a picture frame is comprised of a hollow, frame structure having a front opening through which objects can be placed in and removed from the inner chamber thereof, a mirror on the front panel thereof, a loose-leaf clip on the top edge thereof for holding picture frame sheets, a note book, a memo pad or a wall calendar. The side wall of the base frame is formed of a plurality of transverse ribs curvilinearly bent inward and outward to define a surrounded area serving as a pen case.

The present invention will become more apparent from the following detailed description of preferred embodiments of the invention with reference made to the annexed drawings as hereinafter.

DETAILED DESCRIPTION OF THE PREFERRED EMBODIMENTS

Figure 1:
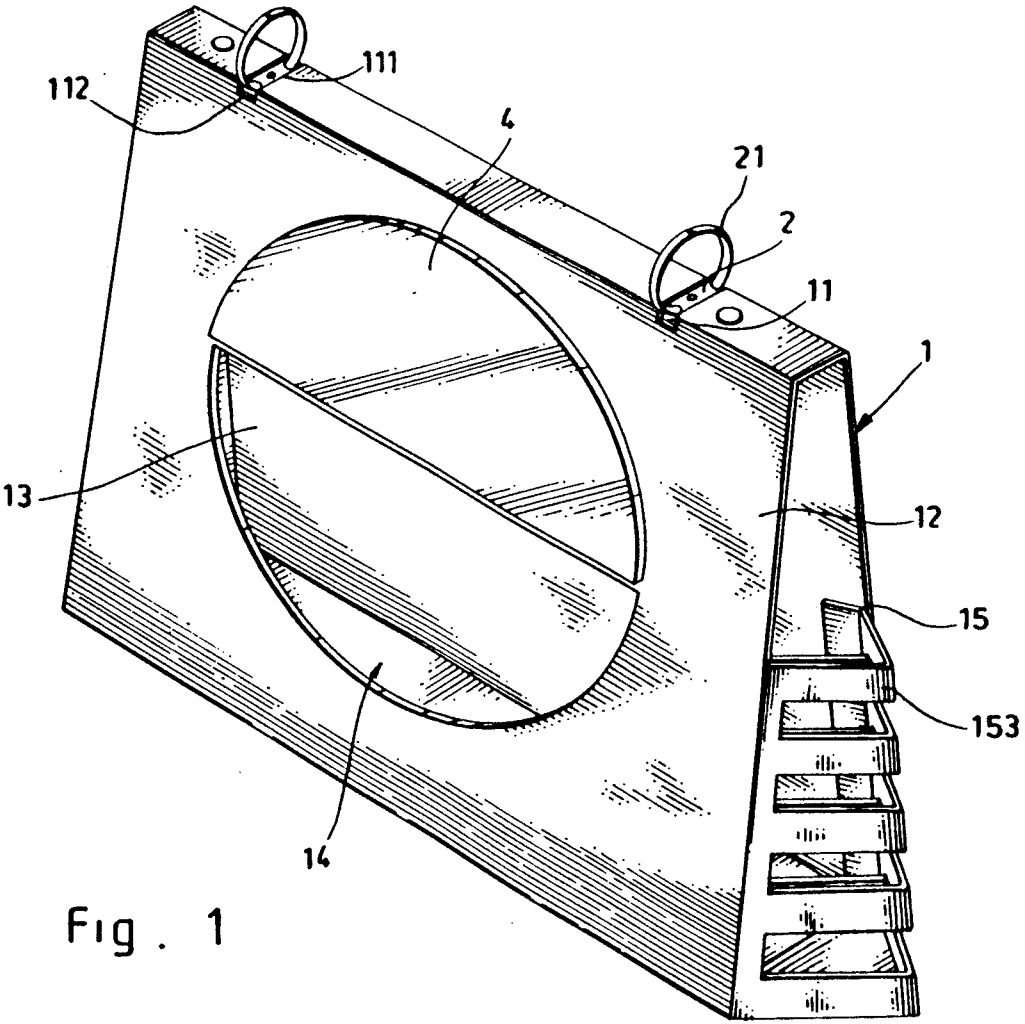
FIG. 1 is a perspective of a base frame according to the present invention.

Referring to FIG. 1, there is shown an embodiment of picture frame in accordance with the present invention and generally comprised of a hollow base frame 1 in structure. The base frame 1 comprises two elongated holes 11 transversely provide on its top edge in parallel with each other so that a loose-leaf clip 2, which has two releasable clamping rings 21, can be conveniently mounted thereon with its two releasable clamping rings 21 set in the two elongated holes 11 for releasably holding a plurality of frame boards 3 and loose leaves 6. The loose-leaf clip 2 may be fixedly mounted on the top edge of the base frame 1 by rivets, or directly attached to the top edge of the base frame 1 by means of adhesive glue. The two clamping rings 21 of the loose-leaf clip 2 each have a diameter not less than the length of the horizontal portions 111 of the elongated holes 11, so that they can be stably retained at the two opposite ends 112 of the elongated holes 11.

According to the present invention, a frame board 3 comprises a front sheet which has an opening 32 serving as a show window, and a back sheet 33 which is attached to the front sheet to define therebetween a space for holding a picture. The frame boards 3 as well as the loose leaves 6 have each two holes 31 near its side edge at locations corresponding to the two clamping rings 21, so that they can easily be removed from or replaced on the base frame 1. The loose leaves 6 can include a calendar, a telephone note-book, a writing pad or a memo pad.

Figure 2:
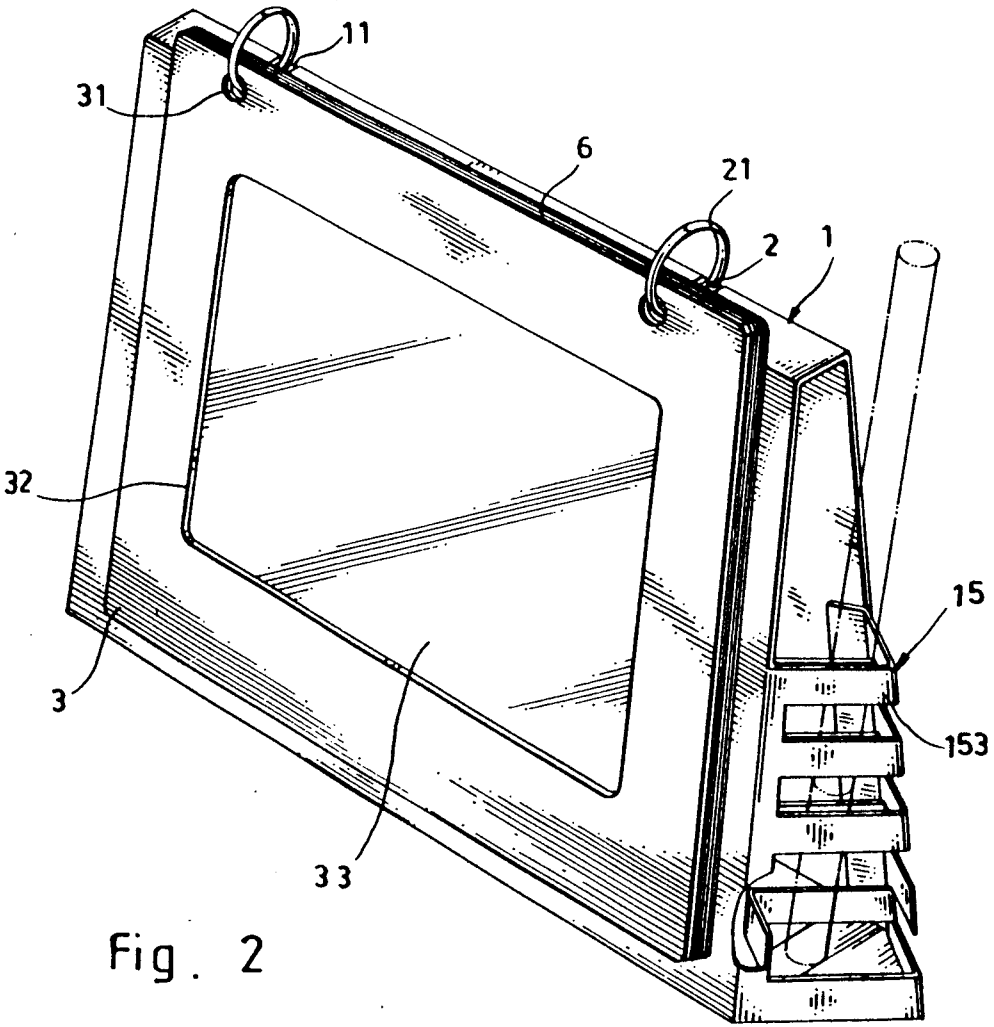
FIG. 2 is a schematic assembly view of the present invention, in which the front opening of the base frame is covered with picture frame boards and the transverse ribs are bent outward for holding longer objects.
Figure 3:
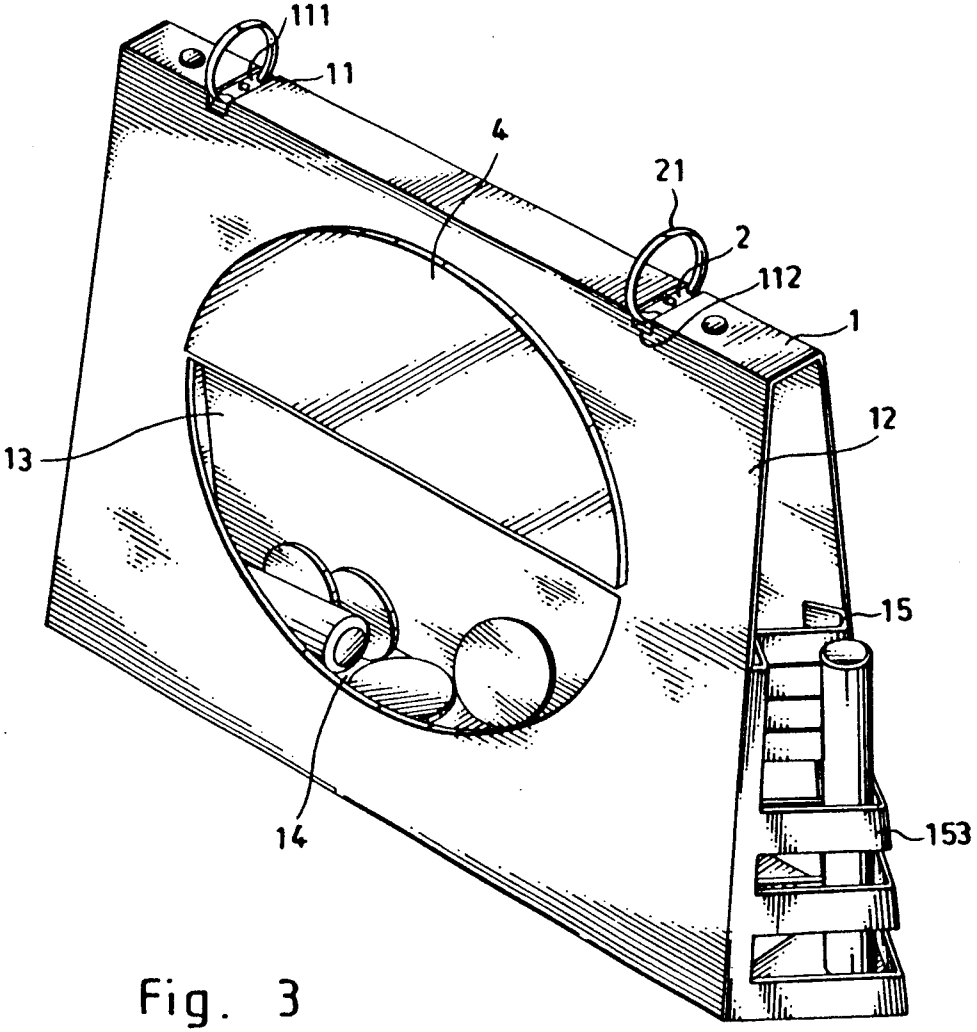
FIG. 3 is a schematic drawing illustrating the use of the present invention, in which the upper transverse ribs are bent inward with the lower transverse ribs bent outward for holding shorter objects.

As afore-described, the base frame 1 has a hollow structure which includes an inner space 14 which can be used as a storage chamber for receiving objects. A front opening 13 is made on the front panel 12 of the base frame 1 so that an object can be conveniently placed in or removed from the inner space 14 of the base frame 1. In normal condition, the front opening 13 of the base frame 1 is covered by the picture frame boards 3. As an alternate form of the present invention, the front opening 13 on the front panel 12 of the base frame 1 can be an elongated hole so that the base frame 1 can be used as a bank for saving money. Further, a mirror 4 may be directly mounted on the front panel 12 or attached to a loose-leaf board for releasably mounting on the base frame 1. One or both of the two side panels 15 of the base frame 1 may be punched or integrally made through a shape molding process during the production of the base frame 1 to form several unitary transverse ribs 153. The ribs 153 can be curvilinearly bent inward and outward to define with the base frame 1 a space for holding pens or other elongated writing materials. The transverse ribs 153 may be all bent to project outward for holding a longer object (see FIG. 2) or some of which at the upper side may be bent to project inward with the lower ones bent to project outward for holding a shorter object (see FIG. 3).

As described above, the present invention is to provide a multi-purpose desk-top picture frame which can be used for several purposes. However, it is to be understood that the above drawings and description are for better understanding of the present invention and not intended as a definition of the limits and scope of the invention disclosed. Recognizing that various modifications been apparent, the scope herein shall be defined in the claims as set forth hereinafter.

I claim:

1. A desk-top picture frame comprising a hollow based frame having a top, a front panel, a back panel and two side panels defining a storage space therebetween, said front panel having a mirror thereon and including an opening for placing storage items in said storage chambers, said top having a loose-leaf clip mounted thereon and including two transversely arranged holes each receiving an upward opening clamping ring of said loose-leaf clip, said clamping rings holding at least one loose-leaf by said rings passing through corresponding holes in said loose-leaf, said loose-leaf arranged to cover said opening, one of said side walls includes a plurality of horizontal ribs with a portion thereof bending inward toward said base frame and another portion thereof bending outward from said base frame, whereby said ribs and said base frame together defines an additional storage space for receiving elongated writing instruments.

2. The desk-top picture frame as claimed in claim 1, wherein said loose-leaf includes a front sheet and a back sheet secured together and defining a space therebetween, said front sheet including an opening.

3. The desk-top picture frame as claimed in claim 1, wherein said loose-leaf includes a calendar.

4. The desk-top picture frame as claimed in claim 1, wherein said loose-leaf includes a telephone note book.

5. The desk-type picture frame as claimed in claim 1, wherein said loose-leaf includes a writing pad.

6. The desk-top picture frame as claimed in claim 1, wherein said loose-leaf includes a memo pad.

7. A desk-top picture frame comprising a hollow based frame having a top, a front panel and two side panels defining a storage space therebetween, said front panel including an opening for placing storage items in said storage chamber, said top having a loose-leaf clip mounted thereon and including two transversely arranged holes each receiving an upward opening clamping ring of said loose-leaf clip, said clamping rings holding at least one loose-leaf by said rings passing through corresponding holes in said loose-leaf, said loose-leaf having a mirror attached thereto and covering said opening, one of said side walls includes a plurality of horizontal ribs with a portion thereof bending inward towards said base frame and another portion thereof bending outward from said base frame, whereby said ribs and said base frame together defines an additional storage space for receiving elongated writing instruments.

8. The desk-type picture frame of claim 7, including an additional loose-leaf having holes receiving said clamping ring, said additional loose-leaf including a front sheet and a back sheet secured together and defining a space therebetween, said front sheet including an opening.

9. The desk-top picture frame as claimed in claim 7, wherein said additional loose-leaf includes a calendar.

10. The desk-top picture frame as claimed in claim 7, wherein said additional loose-leaf includes a telephone note book.

11. The desk-top picture frame as claimed in claim 7, wherein said loose-leaf includes a writing pad.

12. The desk-top picture frame as claimed in claim 7, wherein said additional loose-leaf includes a memo pad.

* * * * *